US008950354B2

(12) United States Patent
Pao

(10) Patent No.: US 8,950,354 B2
(45) Date of Patent: Feb. 10, 2015

(54) TESTING APPARATUS FOR HYDROSTATIC INTERLOCK OF A LIFEBOAT

(71) Applicant: Chen Yuan Pao, Kaohsiung (TW)

(72) Inventor: Chen Yuan Pao, Kaohsiung (TW)

( * ) Notice: Subject to any disclaimer, the term of this patent is extended or adjusted under 35 U.S.C. 154(b) by 158 days.

(21) Appl. No.: 13/831,804

(22) Filed: Mar. 15, 2013

(65) Prior Publication Data

US 2014/0260581 A1 Sep. 18, 2014

(51) Int. Cl.
*B63B 23/58* (2006.01)
*B63B 23/28* (2006.01)

(52) U.S. Cl.
CPC ..... *B63B 23/28* (2013.01)
USPC ..... 114/378; 73/170.03; 114/377

(58) Field of Classification Search
USPC ..... 73/170.01–170.18
See application file for complete search history.

(56) References Cited

U.S. PATENT DOCUMENTS

| | | | | |
|---|---|---|---|---|
| 5,078,073 | A * | 1/1992 | Betz et al. | 114/377 |
| 2010/0089304 | A1* | 4/2010 | Mora et al. | 114/378 |
| 2012/0247382 | A1* | 10/2012 | Mora et al. | 114/378 |
| 2013/0333609 | A1* | 12/2013 | Mora et al. | 114/378 |

* cited by examiner

*Primary Examiner* — Andre Allen

(57) ABSTRACT

A testing apparatus for the hydrostatic interlock of a lifeboat includes a pressure cylinder provided with a valve. A positive-negative pressure annular fastener made of soft plastic material is assembled on the topside of the pressure cylinder and has its topside formed with an attaching surface. A U-shaped support frame is fixed at the outer side of the pressure cylinder, and a telescopic support holder is connected to the U-shaped support frame. An anchor base is positioned under the telescopic support holder, and a manual pump has a tube connected to the valve, and installed with a pressure gauge. The testing apparatus for the hydrostatic interlock of a lifeboat in the invention can simulate the launchings pressure of a lifeboat to carry out actual hooks release in a lifeboat drill, able to ensure safety of lives of the personnel who participate in the drill.

5 Claims, 5 Drawing Sheets

TESTING APPARATUS FOR HYDROSTATIC INTERLOCK OF A LIFEBOAT

BACKGROUND OF THE INVENTION

1. Field of the Invention

This invention relates to a testing apparatus for the hydrostatic interlock of a lifeboat, particularly to one having function of simulating launching pressure to release hook. Furthermore, the lifeboat can also be maintained and serviced properly under security environment to enhance safety of operator in a lifeboat drill.

2. Description of the Prior Art

In view of the sinking accident of the RMS Titanic which caused serious casualties in 1912, the International Maritime Organization (IMO) has paid much attention to the completion and maintenance of a ship's lifesaving equipment. In addition, both the International Convention for the Safety of Life at Sea (SOLAS) and the International Life-Saving Appliance Code (LSA) have prescribed that all the international voyage ships must be equipped with lifeboats, and large merchant ships, passenger liners and ferry boats must regularly carry out operation of the lifeboats' drill and further prescribed that under what condition it is necessary to carry out lifesaving drill when the ship's personnel is changed. The lifesaving equipment of a ship is the last defense for human lives at sea, having important function of rescuing personal on ship in case of emergency, and lifeboats are statutory lifesaving equipment of a ship and the safety of the lifeboats are worthy of attention no matter of shipwreck or lifesaving drill. Accidents have been happening over and over again around the world, and the most of them have happened frequently as launching drills of a lifeboat, which usually caused numbers casualties.

FIG. 1 illustrates a process of launching drill of a conventional suspending type lifeboat 1 in carrying out either on-load or off-load release hooks. When the lifeboat 1 is fallen to water surface, water pressure will get into the lifeboat's cabin through a hydrostatic interlock 10 at the underside of the lifeboat 1 to initiate the inner release device 11 to disengage from the braking condition and, according to indication of the hydrostatic interlock 10, an operator can understand the lifeboat 1 is already on waterborne not on air. After the operator in the cabin of the lifeboat 1 is aware that the release device 11 has completely disengaged from the braking condition and thinks that the lifeboat 1 has been waterborne as so to the interlocker is unlocked by the interlocking mechanism of the hydrostatic interlock 10, the operator will pull a first control handle 12 and a second control handle 13 to release a fore hook 14 and an aft hook 15, thus completing the release hooks as lifeboat launching drill. However, the main causes of accident cases occurred in the lifeboats' launching drill generally include (1) deficiency in maintenance, (2) imperfection and impropriety in design and (3) incorrectness and disqualification in training. Whether the equipment of a lifeboat can be operated normally must be examined before the lifeboat's launching drill; otherwise accidents of failing to release or early decoupling the hooks may be happened during launching drill. Therefore, it is extremely important to insure the safety of human lives during lifeboat drill and provide a safe and security environment or method for lifeboat drills.

SUMMARY OF THE INVENTION

A testing apparatus for the hydrostatic interlock of a lifeboat in the present invention is able to solve the problem which a conventional lifeboat cannot timely find out whether its mechanism can be operated normally before launching drill.

The objective of this invention is to offer a testing apparatus for the hydrostatic interlock of a lifeboat, able to simulate the launching pressure of a lifeboat to carry out launching drill and enabling a lifeboat to be maintained and serviced under security circumstances as so to enhance safety of the operators during the drill.

The testing apparatus for the hydrostatic interlock of a lifeboat in the present invention includes a pressure cylinder provided with a valve. A positive-negative pressure annular fastener made of soft plastic material is assembled on the topside of the pressure cylinder and formed with an attaching surface on the topside.

A U-shaped support frame is fixed at outer side of the pressure cylinder, and a telescopic support holder is connected with the U-shaped support frame. An anchor base is disposed under the telescopic support holder, and a manual pump is provided with a tube connected to the valve of the pressure cylinder, further provided with a pressure gauge. The testing apparatus can be used to simulate the launching pressure of the lifeboat during the drill.

The positive-negative pressure annular fastener of the testing apparatus in the present invention can be made of silica gel or rubber.

The pressure cylinder of the testing apparatus for the hydrostatic interlock of a lifeboat in the present invention has its outer wall bored with threaded holes, and the U-shaped support frame is combined with the pressure cylinder by screws threadably secured in the threaded holes of the pressure cylinder. The U-shaped support frame is provided with a connecting base connected to the telescopic support holder.

The anchor base of the testing apparatus for the hydrostatic interlock of a lifeboat in the present invention is formed with an insert groove for the telescopic support holder to be inserted therein, able to stably hold the telescopic support holder in position.

The advantages of this invention are described as follows:

1. The testing apparatus of this invention can simulate the launching pressure of a lifeboat to enable operators to carry out action of release hook in drill, and such drill can be done repeatedly, especially wrong steps able to be found in the drill. Further, the drill can be done in slow motion for attentively inspecting the motions of the respective mechanism so as to find out defects and unqualified parts which are required repairing and servicing, able to enhance safety of the operators in drill.

2. The testing apparatus of this invention is applicable to different-typed hydrostatic interlocks, not affected by the shape of the inlet flange or the guard net of the hydrostatic interlock, and the positive-negative pressure annular fastener on the topside of the pressure cylinder can match with different curved underside of a lifeboat, able to be tightly sucked on the underside of the lifeboat to stabilize the pressure.

3. The U-shaped support frame of this invention is able to stably prop the pressure cylinder and make the positive-negative pressure annular fastener of the pressure cylinder tightly stuck to the underside of the lifeboat, needless to employ human labor for supporting and hence able to save manpower in the drill.

4. The telescopic support holder of this invention has its lower end firmly positioned by the anchor base, unnecessary to rely on human labor for supporting and having buffering effect for absorbing great impact force to avoid damaging a lifeboat's hull.

5. The manual pump of this invention can provide stable pressure, and the pressure gauge enables operators to observe clearly and record the motion pressure of the hydrostatic interlock and observe the motions of unlocking the interlocker when the hydrostatic interlock reaches to the pressure value set by the manufacturer of the lifeboat and also observe the recovery motion into interlocking condition after releasing pressure, thus able to truly understand the reliability and correctness of the hydrostatic interlock before hosting the drill.

6. This invention can allow the maximum number of persons limited by the lifeboat itself to view, to emulate and to operate inside and outside the lifeboat as truly simulate the launching pressure and carry out the drill, able to attain best effect and safety of drilling.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
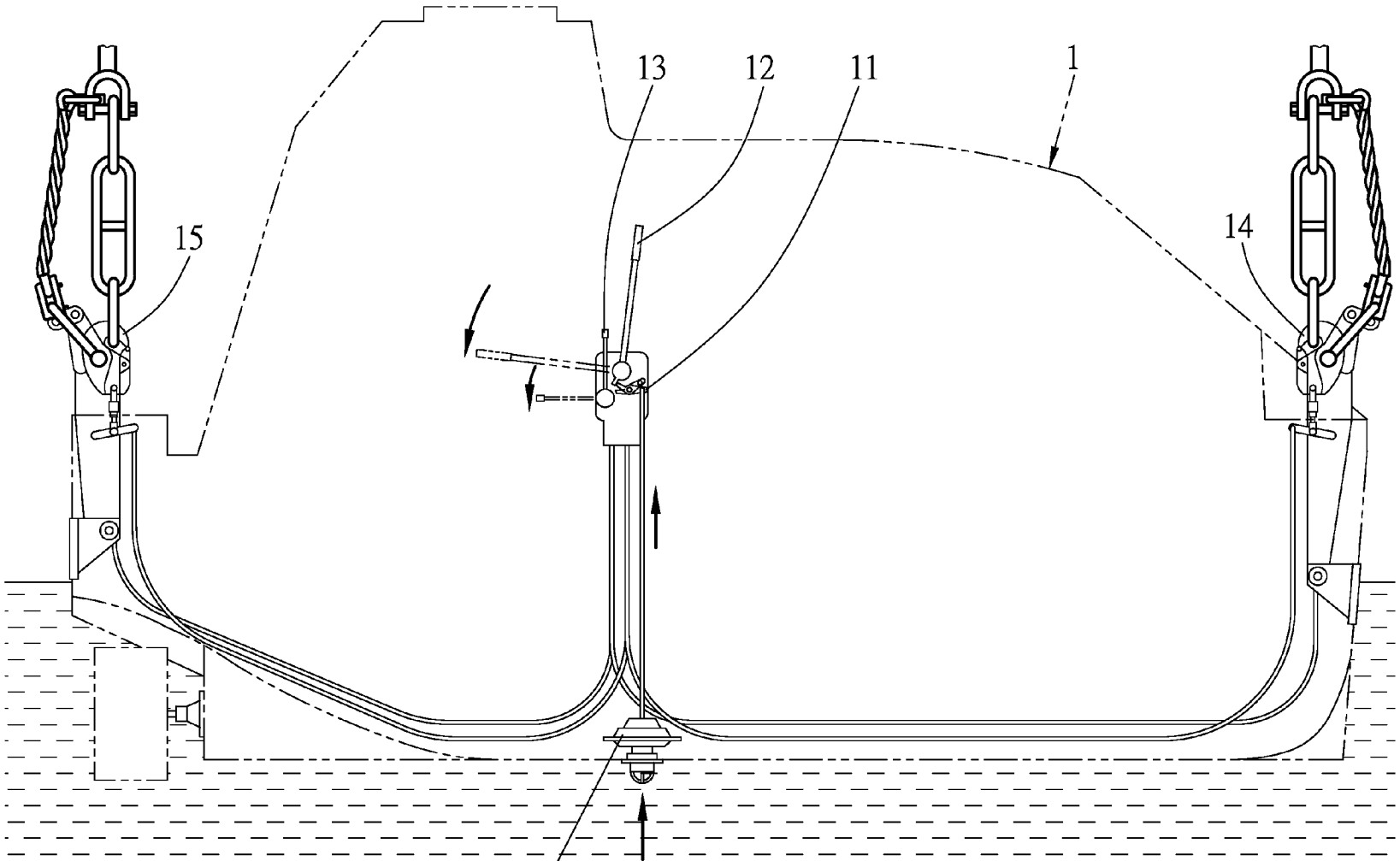
FIG.1 (PRIOR ART)
FIG. 1 is schematic view of a conventional lifeboat and hydrostatic interlock in a using condition.
Figure 2:
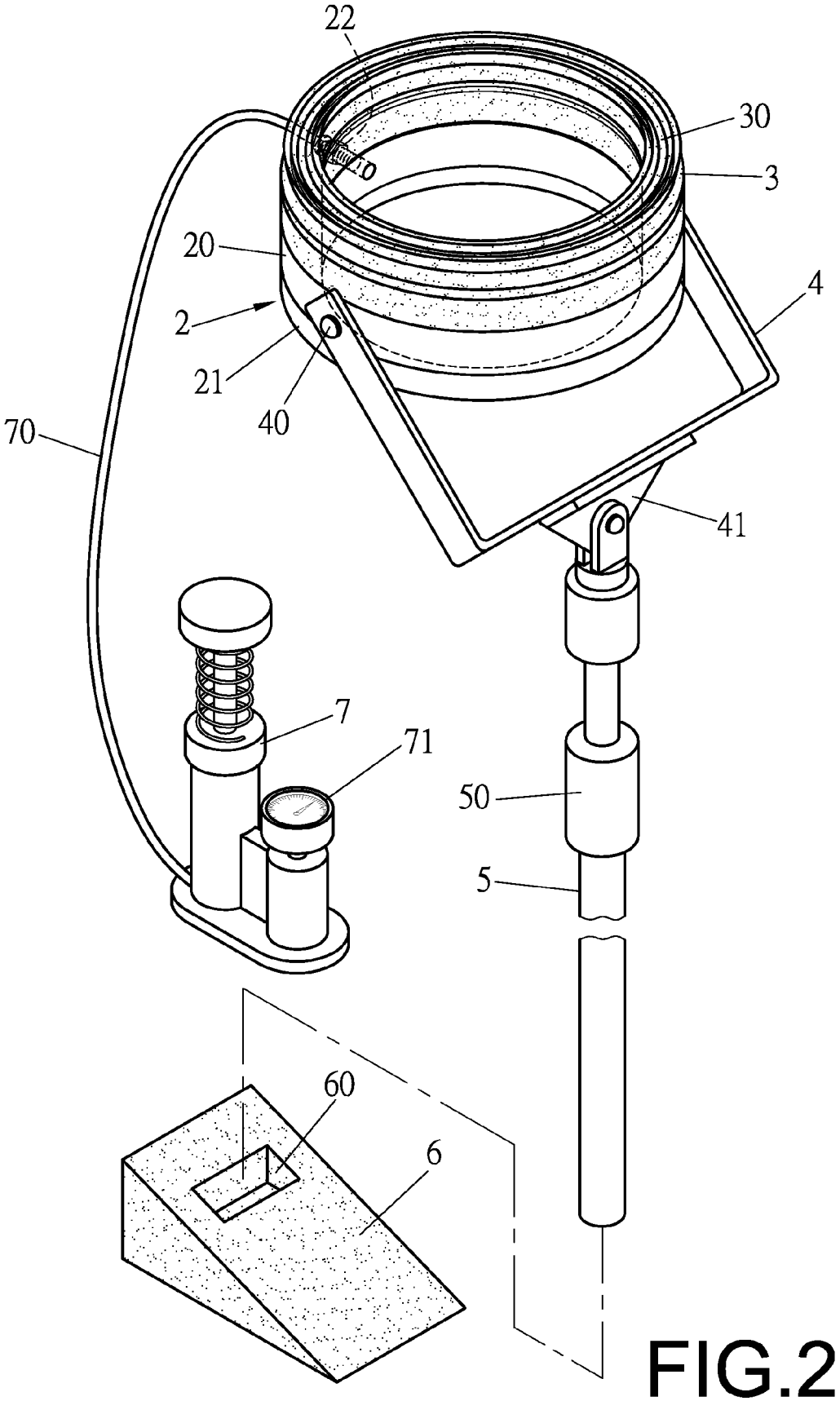
FIG. 2 is a perspective view of a testing apparatus for the hydrostatic interlock of a lifeboat in the present invention.
Figure 3:
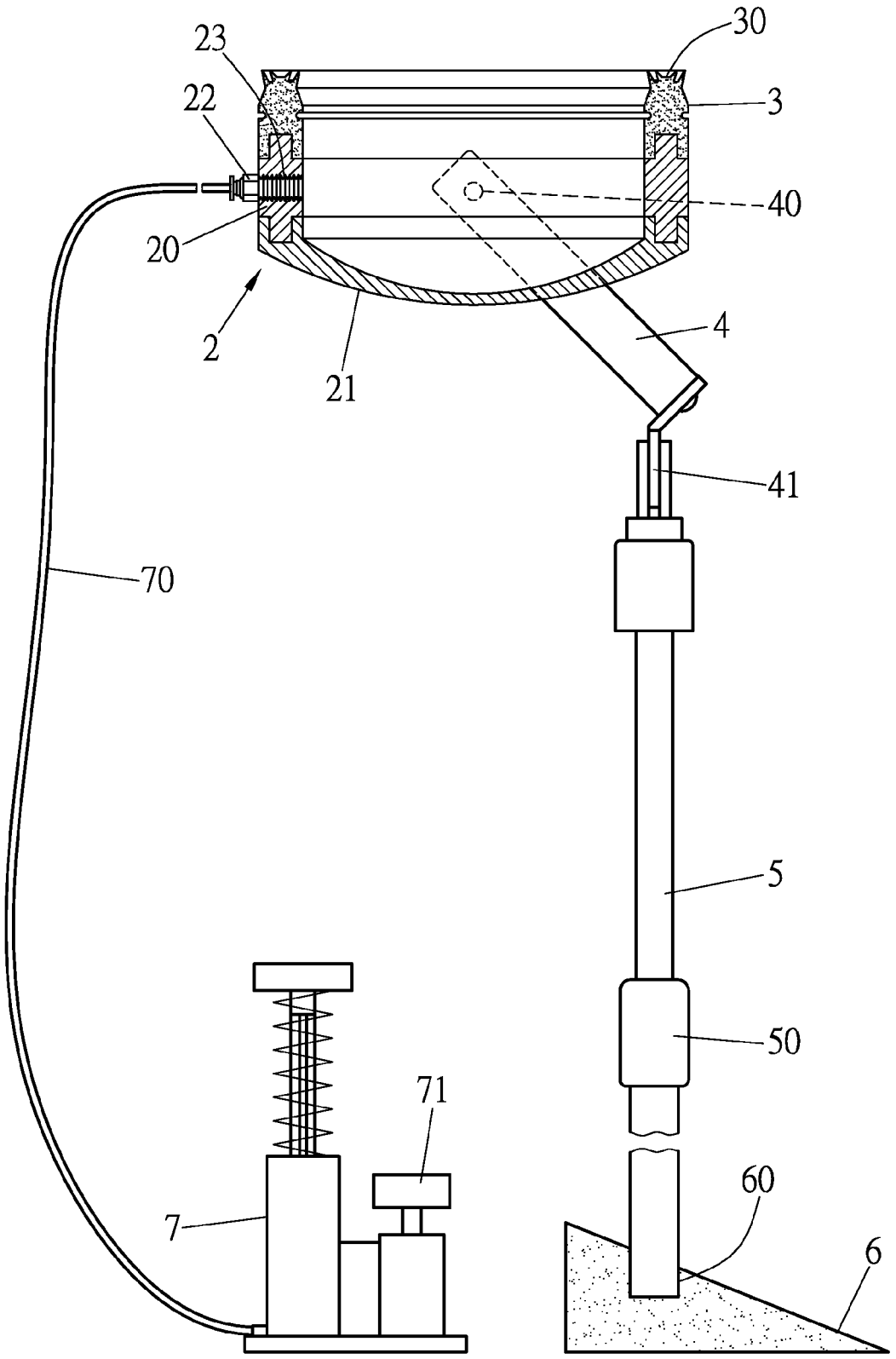
FIG. 3 is plane view of the testing apparatus for the hydrostatic interlock of a lifeboat in the present invention.
Figure 4:
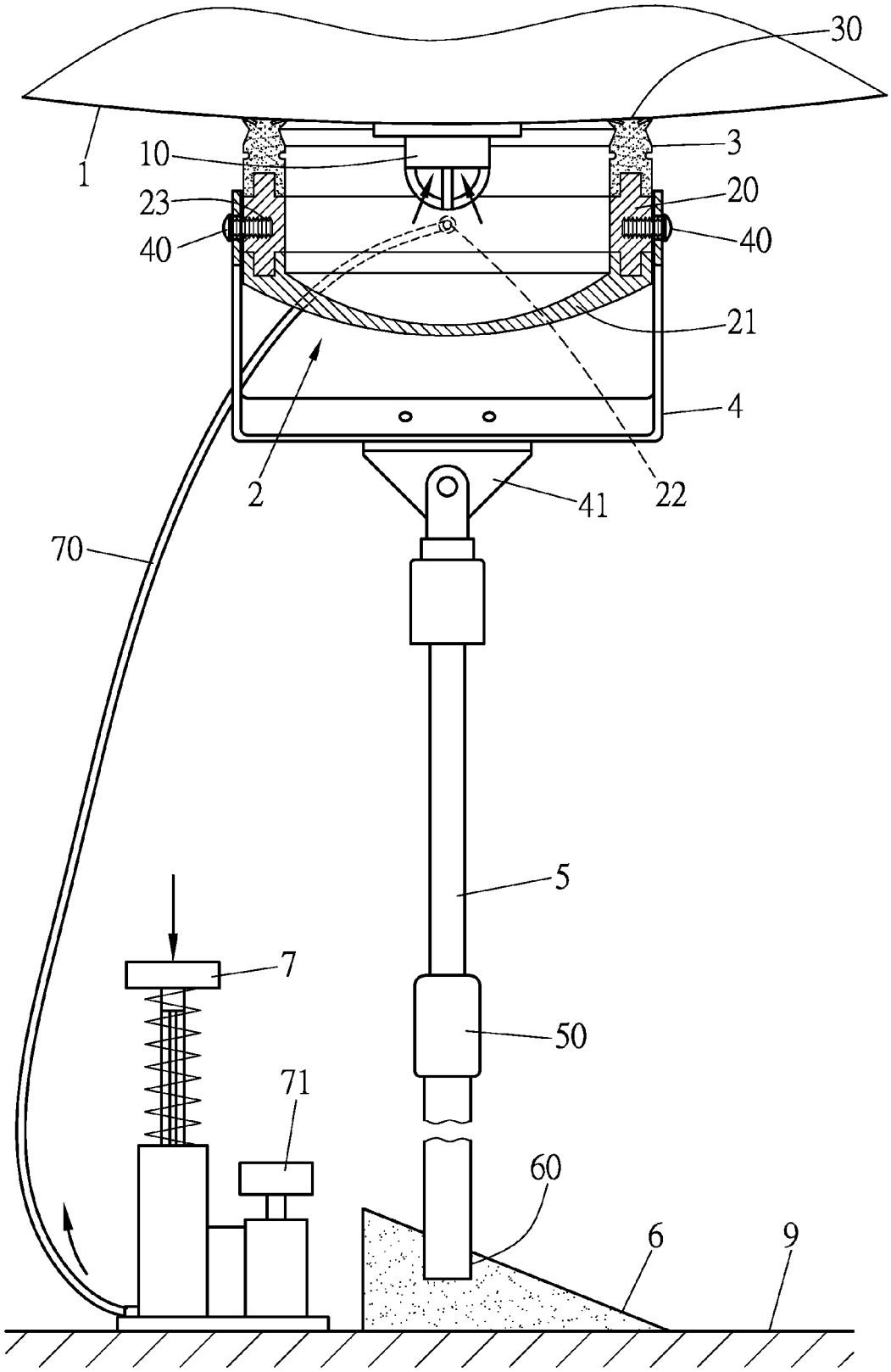
FIG. 4 is a schematic view of the testing apparatus assembled at the underside of a lifeboat in the present invention.

A preferred embodiment of a testing apparatus for hydrostatic interlock of a lifeboat in the present invention, as shown in FIGS. 2-4, includes a pressure cylinder 2, a positive-negative pressure annular fastener 3, a U-shaped support frame 4, a telescopic support holder 5, an anchor base 6 and a manual pump 7 as main components combined together.

The pressure cylinder 2 consists of a cylinder body 20 and a cylinder bottom 21 combined together and the pressure cylinder can also be formed integrally. The cylinder body 20 of the pressure cylinder 2 is provided with a valve 22 and bored with two opposite threaded holes 23.

The positive-negative pressure annular fastener 3 made of soft plastic material like silica gel or rubber is assembled on the upper side of the pressure cylinder 2 and has its topside provided with an attaching surface 30 like a adhesive structure of a sucker.

The U-shaped support frame 4 is fixed at the outer side of the pressure cylinder 2 and threadably screwed into the two threaded holes 23 of the cylinder body 20 of the pressure cylinder 2 by screws 40, further provided with a connecting base 41.

The telescopic support holder 5 secured on the connecting base 41 of the U-shaped support frame 4 is disposed with a positioning device 50, which is a positioning structure of a ordinary telescopic rod. The telescopic support holder 5 is able to be extended its' length for positioning.

The anchor base 6 positioned under the telescopic support holder 5 is formed with an insert groove 60.

The manual pump 7 is provided with a tube 70 connected with the valve 20 of the pressure cylinder 2, and a pressure gauge 71.

Figure 5:
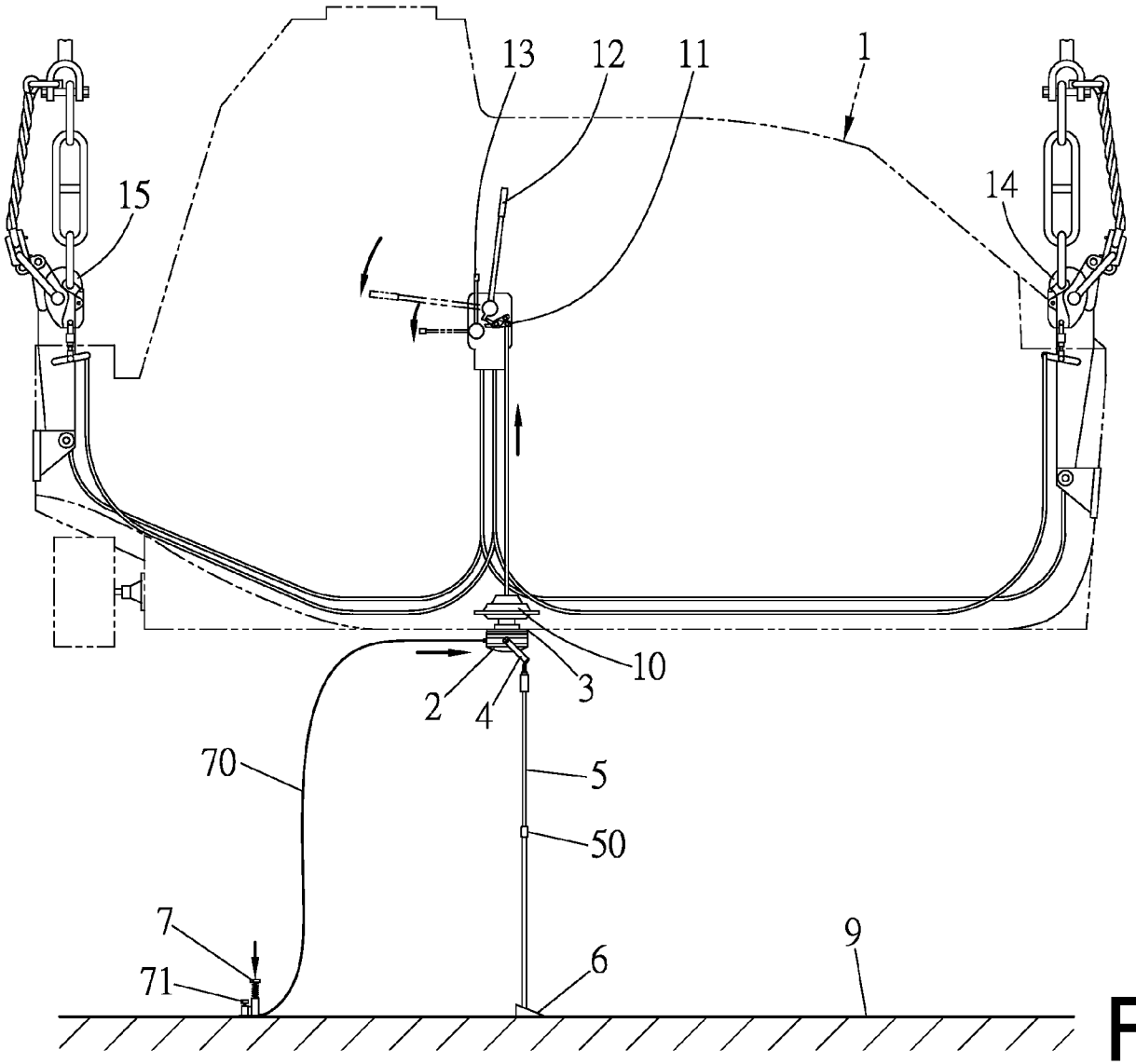
FIG. 5 is schematic view of the testing apparatus in a using condition in the present invention.

In using, referring to FIGS. 2-5, firstly, the pressure cylinder 2 of the testing apparatus is firmly covered around the hydrostatic interlock 10 at the underside of a lifeboat 1 and forcefully pressed toward the underside of the lifeboat 1 to have the attaching surface 30 of the positive-negative pressure annular fastener 3 on the pressure cylinder 2 firmly stuck to the underside of the lifeboat 1, as shown in FIG. 4. Since the positive-negative pressure annular fastener 3 is made of soft plastic material, therefore, the positive-negative pressure annular fastener 3 can match with different-shaped undersides of lifeboats, able to be deformed and tightly stuck to the underside of the lifeboat. Next, the positioning device 50 on the telescopic support holder 5 is loosened to extend the length of the telescopic support holder 5 and then, the anchor base 6 is positioned under the telescopic support holder 5 to have the lower end of the telescopic support holder 5 inserted and positioned in the insert groove 60 of the anchor base 6. At this time, the telescopic support holder 5 has one end propping the pressure cylinder 2 via the U-shaped support frame 4 and the other end positioning on the body of a mother ship 9 via the anchor base 6 and, after the extension length of the telescopic support holder 5 is done, the positioning device 50 is locked in position as so to stably secure the pressure cylinder 2 at the underside of the lifeboat 1. Subsequently, the tube 70 of the manual pump 7 is connected with the valve 22 of the pressure cylinder 2, and the manual pump 7 is used to pump air into the pressure cylinder 2 pressurizing the pressure cylinder 2 and the intake pressure can be indicated by the pressure gauge 71. Meanwhile, the pumped air is entering into the pressure cylinder 2 through the tube 70 and then going into the boat's cabin through the hydrostatic interlock 10 at the underside of the lifeboat 1 as so to initiate the inner release device 11 to be disengaged from the braking state, as shown in FIG. 5. Thus, the launching state of the lifeboat 1 can be simulated by means of the testing apparatus of this invention. After knowing that the release device 11 has completely disengaged from the braking state, the operator in the cabin of the lifeboat 1 will pull the first control handle 12 and the second control handle 13 to release the fore hook 14 and the aft hook 15, thus able to simulate the launching pressure of the lifeboat 1 and accomplish the real release hooks drill The testing apparatus for the hydrostatic interlock of a lifeboat of this invention can be completely covered around the outer side of the hydrostatic interlock 10 at the underside of the lifeboat 1, as shown in FIG. 4, able to be covered around different-typed hydrostatic interlocks and firmly stuck to the underside of the lifeboat, not influenced by the shape of the inlet flange and the guard net of the hydrostatic interlock 10.

The U-shaped support frame 4 of the testing apparatus can alertly swing along with the curved underside of a lifeboat, and the soft positive-negative pressure annular fastener 3 fixed on the topside of the pressure cylinder 2 can be completely and closely stuck to various-shaped undersides of lifeboats and further, the attaching surface 30 of the positive-negative pressure annular fastener 3 can stably and tightly be sucked to the underside of a boat.

The testing apparatus of this invention can be stably supported and positioned by the U-shaped support frame 4 and the telescopic support holder 5 as well as the anchor base 6, and the pressure cylinder 2 can also be positioned steadily, needless to employ human labor and thus saving manpower in the drill.

The testing apparatus of this invention can simulate the launching pressure of a lifeboat under safety circumstances and can carry out actual release hooks drill in a security environment, therefore, the lifeboat 1 is unnecessary to be really suspended and launched into water in the drill, able to avoid causing accidents in launching drill and ensure safety of personnel's lives.

The manual pump 7 of this invention can provide stable imitative pressure, and the pressure gauge 71 of this invention enables operators to observe clearly and record the operating pressure of the hydrostatic interlock 10 and also observe the motions of unlocking the interlocker when the hydrostatic interlock 10 reaches to a pressure value set by the manufacturer of the lifeboat 1 and meanwhile observe the motions of recovering the interlocking state after pressure is released. Thus, before hosting launching drill of the lifeboat 1, operators can truly understand the reliability and correctness of the hydrostatic interlock 10.

While the preferred embodiment of the invention has been described above, it will be recognized and understood that various modifications may be made therein and the appended claims are intended to cover all such modifications that may fall within the spirit and scope of the invention.

What is claimed is:

1. A testing apparatus for the hydrostatic interlock of a lifeboat comprising a pressure cylinder, said pressure cylinder provided with a valve, a positive-negative pressure annular fastener assembled on a topside of said pressure cylinder, said positive-negative pressure annular fastener made of soft plastic material, said positive-negative pressure annular fastener having a topside formed with an attaching surface, a U-shaped support frame secured at outer sides of said pressure cylinder, a telescopic support holder connected to said U-shaped support frame, an anchor base positioned under said telescopic support holder, a manual pump disposed with a tube, said tube connected with said valve of said pressure cylinder, said manual pump installed with a pressure gauge.

2. The testing apparatus for the hydrostatic interlock of a lifeboat as claimed in claim 1, wherein said positive-negative pressure annular fastener is made of silica gel.

3. The testing apparatus for the hydrostatic interlock of a lifeboat as claimed in claim 1, wherein said positive-negative pressure annular fastener is made of rubber.

4. The testing apparatus for the hydrostatic interlock of a lifeboat as claimed in claim 1, wherein said pressure cylinder has outer walls bored with threaded holes, and said U-shaped support frame is threadably secured with said threaded holes of said pressure cylinder, said U-shaped support frame provided with a connecting base for connecting said telescopic support holder.

5. The testing apparatus for the hydrostatic interlock of a lifeboat as claimed in claim 1, wherein said anchor base is provided with an insert groove for said telescopic support holder to be inserted and positioned therein.

* * * * *